US007412071B2

(12) United States Patent
Wu

(10) Patent No.: US 7,412,071 B2
(45) Date of Patent: Aug. 12, 2008

(54) LOW-INDUCTANCE ELECTROMAGNETIC DRIVE WITHOUT DRIVING THE MAGNETIC FLUX CIRCUIT

(75) Inventor: Qijun Wu, Zhejiang (CN)

(73) Assignee: Yuyao Temperature Instrument Factory Co., Ltd., Yuyao, Zhejiang Province (CN)

( * ) Notice: Subject to any disclaimer, the term of this patent is extended or adjusted under 35 U.S.C. 154(b) by 137 days.

(21) Appl. No.: 10/561,006

(22) PCT Filed: Jun. 14, 2004

(86) PCT No.: PCT/CN2004/000638

§ 371 (c)(1),
(2), (4) Date: Dec. 16, 2005

(87) PCT Pub. No.: WO2004/112429

PCT Pub. Date: Dec. 23, 2004

(65) Prior Publication Data

US 2007/0098208 A1 May 3, 2007

(30) Foreign Application Priority Data

Jun. 18, 2003 (CN) ..... 03 1 49226

(51) Int. Cl.
*H04R 25/00* (2006.01)

(52) U.S. Cl. ..... 381/412; 381/401; 381/402; 381/406; 381/409; 381/414

(58) Field of Classification Search ..... 381/400, 381/401, 406, 412, 419–422
See application file for complete search history.

(56) References Cited

U.S. PATENT DOCUMENTS 3,679,844 A * 7/1972 Derkacz ..... 381/420
4,427,845 A * 1/1984 Yoshida ..... 381/94.9
4,783,824 A * 11/1988 Kobayashi ..... 381/402
6,563,933 B1 5/2003 Niederdraenk
6,993,147 B2 * 1/2006 Guenther ..... 381/407

FOREIGN PATENT DOCUMENTS

| | | | |
|---|---|---|---|
| CN | 1296373 | A | 5/2001 |
| DE | 199 54 880 | C1 | 1/2001 |
| EP | 1 059 647 | A1 | 12/2000 |

* cited by examiner

*Primary Examiner*—Wayne Young
*Assistant Examiner*—Dionne H Pendleton
(74) *Attorney, Agent, or Firm*—James P. Muraff; Neal, Gerber & Eisenberg LLP

(57) ABSTRACT

The present invention relates to a low-inductance electromagnetic drive without driving magnetic flux circuit, which comprises a magnetic pole, a drive coil, an upper magnetic inductive board, a permanent magnet and a lower magnetic-inductive board. The magnetic pole is integrated with the lower magnetic-inductive board, and the permanent magnet is located between the upper magnetic-inductive board 4 and lower magnetic-inductive board 6. The drive coil is wrapped around the magnetic pole and is movable in the axial direction. The electromagnetic drive further comprises the fastening coil, and the fastening coil is fastened to a certain proper place of the magnetic flux circuit of the drive coil. Furthermore, the fastening coil is connected with the drive coil in opposite phase. The present invention is characterized in that the drive source applies the excitation to the fastening coil in an equivalent quantity as the drive coil but in opposite phase, so that the excitation energy generated by the current flowing through the speaker for the magnetic flux circuit system is reduced to the minimum, the inductance quantity of the speaker is decreased to the minimum, and the sound distortion of the vibration system connected with the drive coil is decreased.

5 Claims, 4 Drawing Sheets

LOW-INDUCTANCE ELECTROMAGNETIC DRIVE WITHOUT DRIVING THE MAGNETIC FLUX CIRCUIT

CROSS-REFERENCE TO RELATED APPLICATIONS

This application is a U.S. national stage application under 35 U.S.C. § 3.71 of international stage application number PCT/CN2004/000638, filed Jun. 14, 2004, which claims priority of Chinese patent application serial number 03149226.6, filed Jun. 18, 2003.

TECHNICAL FIELD

The present invention relates to an electromagnetic drive. More specifically, this invention relates to a low-inductance electromagnetic drive without driving magnetic flux circuit for improving the recording and playing quality of an audio signal. The electromagnetic drive of this invention can be used in loudspeakers, earphones and acoustic transducers.

BACKGROUND OF THE INVENTION

The audio and/or video apparatus is popular in people's lives. There are energy converters for converting sound energy to electric energy mutually in audio and/or video, such as loudspeakers, earphones and sonic transducers (microphones). The energy conversion between electricity and sound is performed by applying a magnetic field on a current-carrying conductor in a converter which comprises the driving system, vibrating system and supporting system. The electromagnetic energy converters with drive coils and inductance are employed in the driving system. The inductive impedance changes with the variation of frequency, i.e., when the frequency rises, the inductive impedance increases so that the obtained energy of the electromagnetic energy converter changes, which will lead to the change of driving force. At the same time, because of the existence of inductance, the phase shifts will occur due to the voltage and the current through the loudspeaker, which will lead to defective feedback to the power amplifier used for driving the loudspeaker. Moreover, due to the effects of conversion between electric energy and magnetic energy and the magnetic hysteresis, the energy supplied to the drive coil of the loudspeaker will excite the magnetic circuit of the loudspeaker to generate magnetic energy that is stored in the magnetic circuit system of loudspeaker. When the phase of voltage changes in combination with the effect of magnetic energy converting to electric energy, the energy stored in the magnetic circuit of loudspeaker will act on the drive coil via the differential resistance of the power amplifier, which will lead to frequency response and distortion of the loudspeaker, earphone and sonic transducer.

As far as the inventor of this invention knows, a short-circuit ring 8 was installed in the sensitive position of drive coil 2 to reduce the harmful excitation of the drive coil to the magnetic circuit system and the inductance quantity of electromagnetic drives in some products in the prior art (as shown in FIG. 11), and the short-circuit ring which is generally a conductor such as copper is made into a closed ring and mounted around the periphery of magnetic pole 1. But because only part of the energy produced by drive coil can just be passively consumed by the short-circuit ring, and the short-circuit ring is not connected electrically with the drive coil, the short-circuit ring may not apply positive and equivalent feedback excitation to the magnetic circuit system to counteract the harmful excitation of the drive coil on the magnetic circuit system. The effectiveness is limited, so they are different from this invention.

SUMMARY OF THE INVENTION

In view of the disadvantages of the above prior art, the object of the present invention is to provide a low-inductance electromagnetic drive without driving the magnetic flux circuit, in which the inductive impedance changes are small when the frequency changes, so that the electric energy, obtained by the electromagnetic energy converter, changes are small with the variation of inductive impedance, the phase instability is decreased, and the sound distortion led by the magnetic flux circuit excitation is basically eliminated.

To achieve the above objective of the present invention, a low-inductance electromagnetic drive without driving magnetic flux circuit is provided comprising a magnetic pole 1, a drive coil 2, an upper magnetic inductive board 4, a permanent magnet 5 and a lower magnetic-inductive board 6. The magnetic pole 1 is integrated with the lower magnetic-inductive board 6, and the permanent magnet 5 is located between the upper magnetic-inductive board 4 and lower magnetic-inductive board 6. The drive coil 2 is wrapped or wound around the magnetic pole 1 and is movable in the axial direction. The electromagnetic drive further comprises the first fastening coil 3 with an inductance quantity approximating the equivalent inductance of the drive coil, and the first fastening coil 3 is fixed at a proper position in the magnetic flux circuit and connected with the drive coil 2, or positioned in relation to the drive coil 2, to establish an opposite phase relationship to receive the equivalent and opposite excitation.

The first fastening coil 3 is located between the drive coil 2 and magnetic pole 1, and is fixed to the magnetic pole 1. The first fastening coil 3 is connected with the drive coil 2 by opposite phase in the form of the smallest inductance quantity to receive the equivalent excitation of opposite phase.

The first fastening coil 3 is fixed to the upper magnetic-inductive board 4, and the first fastening coil 3 is connected with the drive coil 2 by opposite phase in the form of the smallest inductance quantity to receive the equivalent excitation of opposite phase.

The first fastening coil 3 is connected with the drive coil 2 by opposite phase in series connection or parallel connection to receive the equivalent excitation of opposite phase.

Though there has been obvious improvement when the ratio of the equivalent inductance between the first fastening coil 3 to the drive coil 2 is in the range from 0.5 to 1.5, it is preferred that the equivalent inductance of the first fastening coil 3 is in close proximity to the drive coil 2.

A low-inductance electromagnetic drive without driving magnetic flux circuit comprises a magnetic pole 1, a drive coil 2, an upper magnetic-inductive board 4, a permanent magnet 5 and a lower magnetic-inductive board 6. The magnetic pole 1 is connected with the lower magnetic-inductive board 6 integrally, and the permanent magnet 5 is located between the upper magnetic-inductive board 4 and lower magnetic-inductive board 6. The drive coil 2 is wrapped around the magnetic pole 1 and is removable in the axial direction. The electromagnetic drive further comprises the first fastening coil 3 and second fastening coil 7. The total inductance quantity of the two fastening coils is approximate to the equivalent inductance of the drive coil 2. The first fastening coil 3 and the second fastening coil 7 are fixed at a proper position in the magnetic flux circuit, and both are connected with the drive coil 2 in opposite phase to receive the equivalent excitation of opposite phase.

The first fastening coil 3 and the second fastening coil 7 are both fixed on the magnetic pole 1 and are both connected with the drive coil 2 by opposite phase in the form of the smallest inductance quantity to receive the equivalent excitation of opposite phase.

The first fastening coil 3 and the second fastening coil 7 are fixed to the magnetic pole 1 and upper magnetic-inductive board 4 respectively, and they are both connected with the drive coil 2 by opposite phase in the form of the smallest inductance quantity to receive the equivalent excitation of opposite phase.

The first fastening coil 3 and the second fastening coil 7 are connected with the drive coil 2 by opposite phase in series connection or parallel connection to receive the equivalent excitation of opposite phase.

The distortion has been amended obviously when the ratio of the total equivalent inductance of the first fastening coil 3 and the second fastening coil 7 to the drive coil 2 is in the range from 0.5 to 1.5. Preferably, the total equivalent inductance quantity of the first fastening coil 3 and the second fastening coil 7 is in close proximity to the drive coil 2.

The first fastening coil 3 can also be made of magnetic metal used for a magnetic conductor.

When choosing the electrical parameters of fastening coil, the principle of "the opposite phase excitation energy produced by fastening coil is in close proximity to the excitation energy produced by drive coil as far as possible so that it may be eliminated by the excitation energy produced by drive coil" should be followed. In practice, there are lots of choices of which the main examples are listed below:

a. When the fastening coils are connected with the drive coils in series, the loudspeaker will work well, if the inductance quantity of the fastening coil is in close proximity to the equivalent inductance quantity of the drive coil, and the coupling factor with the drive coil is near to 1, as well as the direct current resistance is small.
b. When the fastening coils are connected with the drive coils in parallel, preferably, the inductance quantity of the fastening coil is in close proximity to the equivalent inductance quantity of the drive coil, the coupling factor with the drive coil is near to 1, and the total quantity of direct current resistance in the current circuit of the fastening coil is designed in such a way that the excitation energy produced by the drive coil is nearly eliminated by the opposite phase excitation energy produced by the fastening coil as far as possible.
c. When the fastening coils are connected with the drive coils in series and parallel connections, preferably, the total inductance quantity of the fastening coil is in close proximity to the equivalent inductance quantity of the drive coil, the coupling factor of the fastening coil fastening coil with the drive coil is near to 1, and the total quantity of direct current resistance in the current circuit of the fastening coil is designed in such a way that the excitation energy produced by the drive coil is nearly eliminated by the opposite phase excitation energy produced by the fastening coil as far as possible.

No matter what kind of connection is established, as long as the extent of 0.5 to 1.5 times of excitation energy produced by the drive coil is counteracted by the opposite phase excitation energy produced by the fastening coil, the distortion of the loudspeaker is reformed obviously.

Since the drive source applies a positive excitation which is equivalent but in opposite phase as that of drive coil to the fastening coil, the excitation energy produced by the magnetic circuit system as the current flowed through loudspeaker is minimized, the inductance quantity of the loudspeaker is decreased to smallest, and the sound distortion of vibrating system connected with drive coil is diminished.

The technical advantages of the present invention are illustrated below.

Because a fastening coil whose inductance quantity is close to the equivalent inductance quantity of the drive coil is set in the sensitive position of the drive coil in this invention, and fixed and drive coils are connected in opposite phase, the excitation produced by the drive source on the fastening coil is equivalent but reversed to the drive coil. Because the fixed and drive coils produce equivalent but reversed excitation, the two-way excitations will eliminate each other, which will make the excitation energy obtained by the magnetic circuit system of the loudspeaker fall down to the lowest level. As a result, the magnetic intensity of the magnetic circuit system will not change with the variation of the feed-in signal of the loudspeaker, and the sound distortion of the vibrating system connected with the drive coil will diminish.

Since a fastening coil that can produce an equivalent but reversed excitation to the drive coil is achieved in this invention, the inductance quantity of loudspeaker is reduced. As the loudspeaker gets the drive energy in a wide range of frequencies homogeneously, the frequency range of playback is extended.

Since the impedance characteristic of the loudspeaker manufactured by this invention is very close to pure resistance, it is simple to treat the interface of loudspeaker and power amplifier.

The quality of audio recording and playing may be improved by those features at a very low expense.

In which: 1: magnetic pole; 2: drive coil; 3: the first fastening coil; 4: upper magnetic-inductive board; 5: permanent magnet; 6: lower magnetic-inductive board; 7: the second fastening coil; 8: short-circuit ring; 9: diaphragm.

DETAILED DESCRIPTION

This invention may best be understood from the following description of preferred embodiments with reference to the accompanying drawings.

Figure 1:
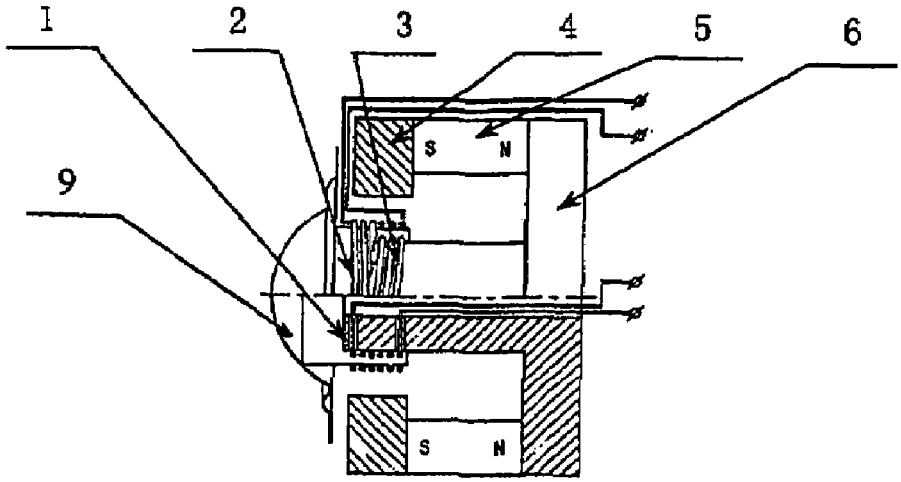
FIGS. 1 and 2 are structural schematic drawings of the drive with one fastening coil of the present invention.

In the first embodiment of the present invention as shown in FIG. 1, an electromagnetic drive comprises a magnetic pole 1, a drive coil 2, a first fastening coil 3, an upper magnetic-inductive board 4, a permanent magnet 5 and a lower magnetic-inductive board 6. The magnetic pole 1 is integrated with the lower magnetic board 6, and the permanent magnet 5 is connected with both the upper magnetic-inductive board 4 and the lower magnetic-inductive board 6. The drive coil 2 is arranged on the magnetic pole 1; the first fastening coil 3 is wrapped and fixed on the magnetic pole 1 adhesively; the drive coil 2 is connected with the first fastening coil 3 in opposite phase.

Figure 2:
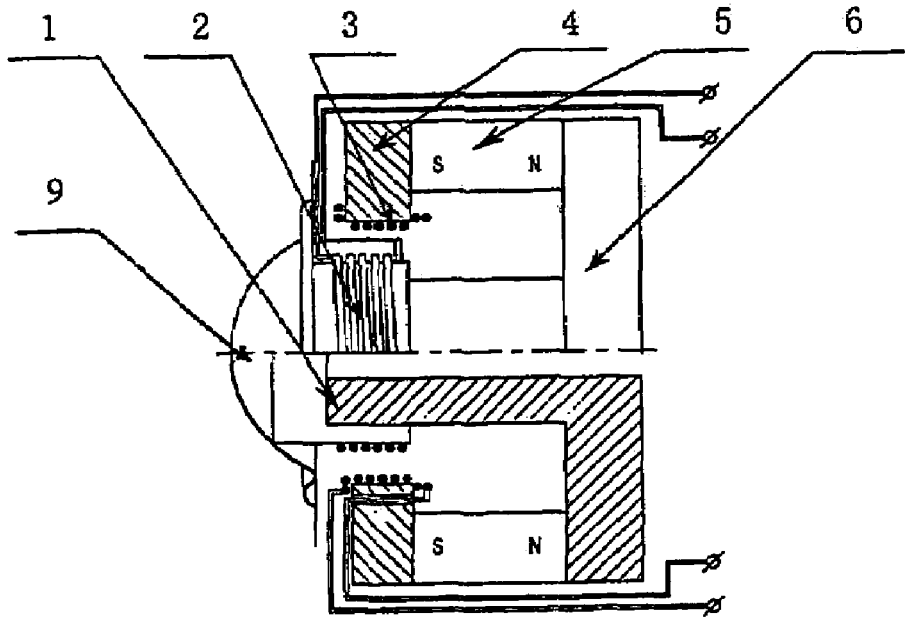

In the second embodiment of the present invention as shown in FIG. 2, an electromagnetic drive comprises a magnetic pole 1, a drive coil 2, a first fastening coil 3, an upper magnetic-inductive board 4, a permanent magnet 5 and a lower magnetic-inductive board 6. The magnetic pole 1 is connected with the lower magnetic board 6 as a whole, and the permanent magnet 5 is connected with both the upper magnetic-inductive board 4 and the lower magnetic-inductive board 6. The drive coil 2 is coupled on the magnetic pole 1; the first fastening coil 3 is fastened on the upper magnetic-inductive board 4 by adhesive; the drive coil 2 is connected with the first fastening coil 3 in opposite phase.

Figure 3:
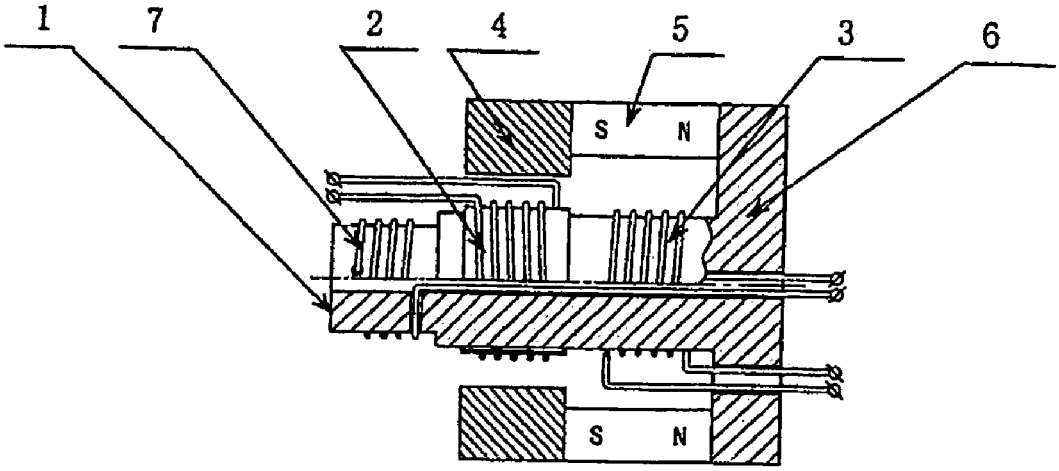
FIGS. 3 and 4 are structural schematic drawings of the drive with two fastening coils of the present invention.

Referring to FIG. 3 of the third embodiment of this invention, an electromagnetic drive comprises a magnetic pole 1, a drive coil 2, a first fastening coil 3, a second fastening coil 7, an upper magnetic-inductive board 4, a permanent magnet 5 and a lower magnetic-inductive board 6. The magnetic pole 1 is integrated with the lower magnetic board 6, and the permanent magnet 5 is set between the upper magnetic-inductive board 4 and the lower magnetic-inductive board 6 and connected with both of them. The drive coil 2, the first fastening coil 3 and the second fastening coil 7 are arranged on the magnetic pole. The two fastening coils are connected with the drive coil in such a way that the quantity of inductance is minimum, and the first fastening coil 3 and the second fastening coil 7 are wrapped and fastened around the magnetic pole 1.

Figure 4:
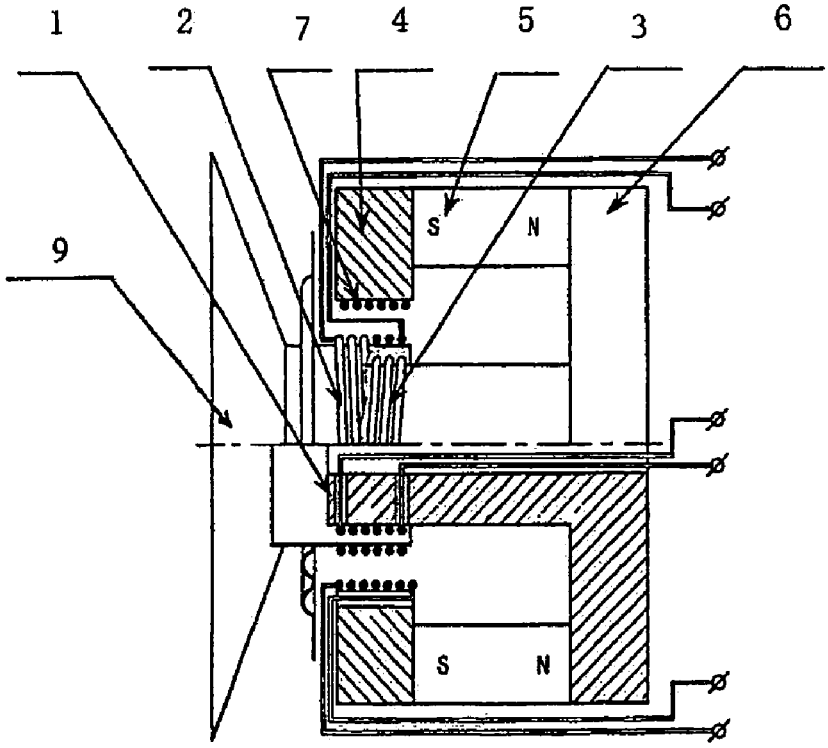

FIG. 4 shows the fourth embodiment of this invention. An electromagnetic drive comprises a magnetic pole 1, a drive coil 2, a first fastening coil 3, a second fastening coil 7, an upper magnetic-inductive board 4, a permanent magnet 5 and a lower magnetic-inductive board 6. The magnetic pole 1 is integrated with the lower magnetic board 6, and the permanent magnet 5 is connected with both the upper magnetic-inductive board 4 and the lower magnetic-inductive board 6. The drive coil 2 and the first fastening coil 3 are arranged around the magnetic pole 1, and the second fastening coil 7 is set on the upper magnetic-inductive board 4. The two fastening coils are connected with the drive coil in minimal quantity of inductance, and the first fastening coil 3 is wrapped and fixed around the magnetic pole 1, while the second fastening coil 7 is connected to the upper magnetic-inductive board 4 by adhesive.

The adhesive described above is the anti-high, or low, temperature adhesive used in electromagnetic drives of the prior art.

Figure 5:
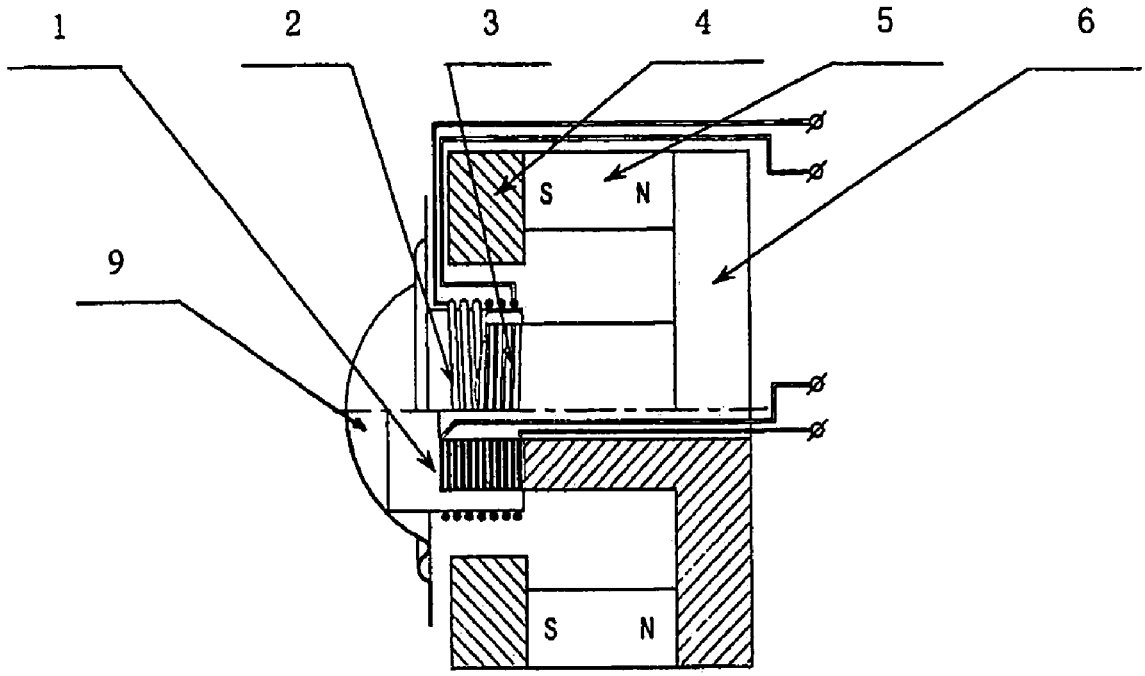
FIG. 5 is a structural schematic drawing of the drive wherein one fastening coil made of the magnetic metal is used as the magnetic conductor as well as of the present invention.
Figure 6:
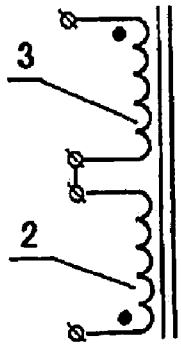
FIG. 6 is a schematic drawing of the fastening coil connected with the drive coil in series of the present invention.
Figure 7:
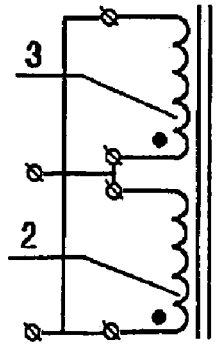
FIG. 7 is a schematic drawing of the fastening coil connected with the drive coil in parallel of the present invention.
Figure 8:
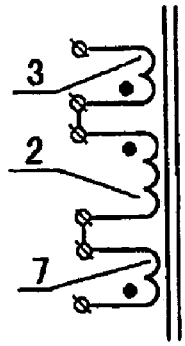
FIG. 8 is a schematic drawing of two fastening coils connected with the drive coil in series of the present invention.
Figure 9:
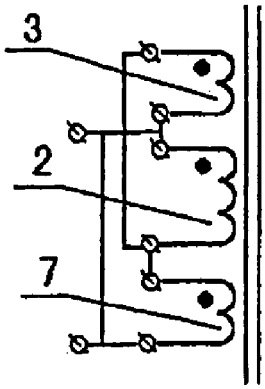
FIG. 9 is a schematic drawing of two fastening coils connected with the drive coil in parallel of the present invention.
Figure 10:
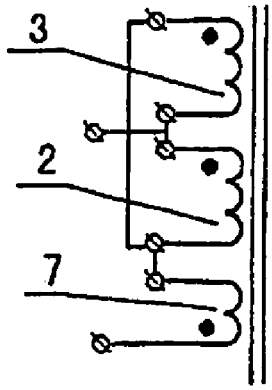
FIG. 10 is a schematic drawing of two fastening coils connected with the drive coil in series-parallel of the present invention.
Figure 11:
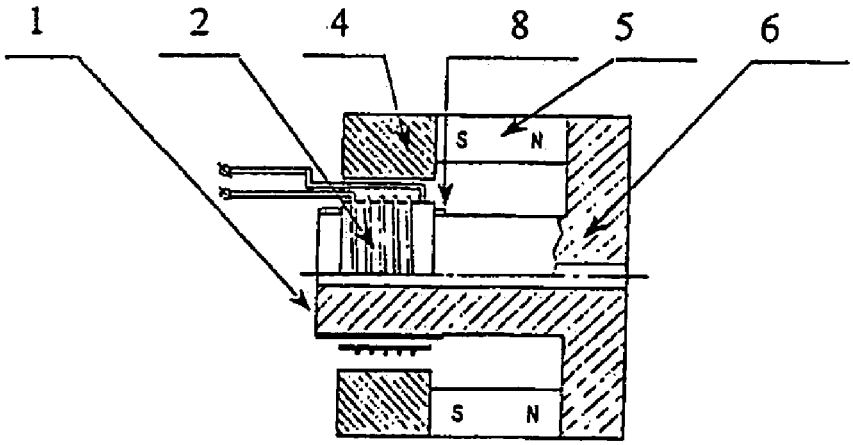
FIG. 11 is a structural schematic drawing of the electromagnetic drive in the prior art.

In the fifth embodiment of this invention as shown in FIG. 5, an electromagnetic drive comprises a magnetic pole 1, a drive coil 2, a first fastening coil 3 made of magnetic metal, an upper magnetic inductive board 4, a permanent magnet 5 and a lower magnetic-inductive board 6. The first fastening coil 3 is connected with the drive coil 2 to minimize the quantity of inductance. The first fastening coil 3 is made of magnetic metal, such as iron, mild steel or nickel-iron alloy etc. One way to produce the fastening coil is that the end part of the magnetic pole 1 made of magnetic metal is processed by external thread cutting to form the coil, and the outer surface of the obtained cutting coil is treated to insulate. Then the obtained cutting coil is engaged and fixed with the un-cutting helix part of the magnetic pole 1 to form the first fastening coil 3 with the function of magnetic pole. Finally, the two ends of the first fastening coil 3 are extended through lead connectors to connect with the drive coil 2 in such a way that the quantity of inductance is a minimum according to FIG. 5, or an equivalent but opposite phase excitation is applied on the fastening coil 3 by the drive source.

When the electromagnetic drive of the present invention is used, the electromagnetic drive in the first or the second embodiment is set on the loudspeaker. The first fastening coil 3 is connected with the drive coil 2 in the opposite phase so that the inductive reactance decreases, the phase of electrical current changes slightly, and the vibrating system is driven by the drive coil 2 to diminish the distortion of sound. Alternatively, the electromagnetic drive in the third or forth embodiment is placed on the loudspeaker, and the first fastening coil 3 and the second fastening coil 7 are set separately on each of the two sides of the drive coil 2, and the drive coil 2 is connected with the first fastening coil 3 and the second fastening coil 7 by the way of lowest inductance quantity.

Preferably, the electromagnetic drive in the fifth embodiment of the present invention is located on the loudspeaker.

According to the formulas: $Leq=L_1+L_2-2M$ and $Leq=L_1L_2-M^2/L_1+L_2+2M$, when the coupling coefficient is 1, the inductive reactance of the two coils with the same inductance quantity and connected in opposite phase is zero, and the impedance is the same as the direct current resistance of the two inductions. Since one or more tight-coupled fastening coils is seated around the drive coil with a huge inductance quantity, in which the total quantity of inductance of the fastening coils is in close proximity to the equivalent inductance of the drive coil, and moreover, an equivalent but reversal excitation is applied on the fastening coils by connecting the fastening coils with the drive coil in opposite phase through lead connector(s), as long as the inductance quantity and resistance value are well chosen, the loudspeaker will present characteristics very close to working under the pure resistance.

For example, the loudspeaker with the electromagnetic drive of the first embodiment, when the loudspeaker is working, the electric energy is fed into the drive coil of the loudspeaker by the drive source (such as an acoustic amplifier). Meanwhile a reversed electric energy is fed into the first fastening coil 3, so the defective excitation produced by the drive coil 2 on the magnetic circuit system of the loudspeaker will be eliminated by the opposite phase excitation produced by the first fastening coil 3 on the magnetic circuit system of the loudspeaker. By this means, the main objective of "without driving the magnetic circuit" of the present invention is achieved, and the problem of the frequency response and distortion occurring in the loudspeaker, earphone and sonic transducer is solved.

I claim:

1. A low-inductance electromagnetic drive without driving a magnetic flux circuit, comprising:

a magnetic pole;

a drive coil;

an upper magnetic inductive board;

a permanent-magnet;

a lower magnetic-inductive board, said magnetic pole being integrated with said lower magnetic-inductive lower board, said permanent magnet being located between said upper magnetic-inductive board and said lower magnetic-inductive board, wherein said drive coil at least partially surrounds said magnetic pole and is movable in an axial direction;

a first fastening coil with an inductance substantially equivalent to an inductance of said drive coil, wherein said first fastening coil is aligned in a position in said magnetic flux circuit and connected with said drive coil in opposite phase to receive the equivalent and opposite excitation; and, said first fastening coil is located between drive coil and said magnetic pole, fixed to said magnetic pole, and connected with said drive coil by opposite phase to obtain the smallest inductance and equivalent excitation of opposite phase.

2. The electromagnetic drive of claim 1, further comprising:

a second fastening coil, wherein the total inductance quantity of said first and second fastening coils is approximately equivalent to the inductance of said drive coil, and wherein said first fastening coil and said second fastening coil are aligned in a position in the magnetic flux circuit, and are connected with said drive coil in opposite phase to receive the approximately the equivalent and opposite excitation.

3. The electromagnetic drive of claim 2, wherein said first fastening coil and second fastening coil are both fixed on the magnetic pole and are both connected with said drive coil by opposite phase to obtain the smallest inductance quantity and the equivalent excitation of opposite phase.

4. The electromagnetic drive of claim 2, wherein said first fastening coil and second fastening coil are fixed to the magnetic pole and upper magnetic-inductive board respectively, and are connected with said drive coil to obtain the smallest inductance quantity and the equivalent excitation of opposite phase.

5. The electromagnetic drive of claim 1, wherein said first fastening coil is made of magnetic metal used for magnetic conducting.

* * * * *